US005397005A

United States Patent [19]

Taccolini

[11] Patent Number: 5,397,005

[45] Date of Patent: Mar. 14, 1995

[54] STEEL MERCHANDISING SYSTEM

[75] Inventor: Ray Taccolini, Villa Park, Calif.

[73] Assignee: Crown Bolt, Inc., Cerritos, Calif.

[21] Appl. No.: 31,583

[22] Filed: Mar. 15, 1993

[51] Int. Cl.[6] ..... A47F 7/00

[52] U.S. Cl. ..... 211/70; 211/163

[58] Field of Search ..... 211/70, 163, 60.1, 70.4, 211/95, 131

[56] References Cited

U.S. PATENT DOCUMENTS

| | | | |
|---|---|---|---|
| 322,600 | 7/1885 | Hazelton . | |
| 722,514 | 3/1903 | Johnson . | |
| 1,065,381 | 6/1913 | Martin . | |
| 1,478,043 | 12/1923 | Matteson . | |
| 1,586,826 | 6/1926 | Michelbach | 211/163 X |
| 2,526,245 | 10/1950 | Lathrop . | |
| 2,575,453 | 11/1951 | Kmentt . | |
| 3,826,378 | 7/1974 | Novak . | |
| 3,981,405 | 9/1976 | Slack . | |
| 5,074,421 | 12/1991 | Coulter | 211/163 X |

FOREIGN PATENT DOCUMENTS

| | | | |
|---|---|---|---|
| 544454 | 2/1932 | Germany | 211/70 |

*Primary Examiner*—Robert W. Gibson, Jr.

*Attorney, Agent, or Firm*—Knobbe, Martens, Olson & Bear

[57] ABSTRACT

A system for vertically storing and displaying elongated articles such as steel rods or the like. A stationary base rotatably supports a tall cylindrical storage rack. A platform with a peripheral rim holds the bottom ends of articles while the top ends are retained by upper braces. The braces include a centered spacer which creates a relief region above it. The articles are removed by lifting to clear the bottom rim and tilted so that the top ends swing into the relief region. The rack is divided into pie-shaped product homes by spokes extending from the spacers. The system may be a stand-alone unit with more than one rack, or a single rack coupled at the top to a support structure. The system also includes outer surfaces on which to display general and specific product information and may also include receptacles for fasteners to be used with the elongated articles.

23 Claims, 4 Drawing Sheets

STEEL MERCHANDISING SYSTEM

FIELD OF THE INVENTION

The present invention relates to rotatable storage units for efficiently storing a number of different types of elongated articles vertically so that selection of and access to the articles is maximized.

BACKGROUND OF THE INVENTION

It is customary to place pipe, long rods, long angle and channel irons and the like on the floors of factories, warehouses, or the like, for ease of handling. This arrangement presents a serious loss of space and considerable shifting of the bars and pipes is often necessary in order to obtain the desired length or size of article which may be at the bottom of the pile. In hardware or building supply retailers, however, the elongated articles cannot be stored on the floor and are typically stored upright in bins. The articles must be withdrawn from the bins by lifting up and over any supporting structure which is often a difficult and awkward task. Furthermore, there is a limited amount of display space available throughout a hardware store yet the space immediately behind the bin is often wasted as there is not enough merchandise to fill that space. Typically, large scaffolding frames supporting durable shelving is installed in hardware stores to maximize the tall ceiling storage space. These scaffold structures often have up to a three-foot depth which is wasted by utilizing vertical bins for storing elongated articles.

Several devices for storing elongated articles in cylindrical units capable of being rotated are known. In particular, in U.S. Pat. No. 2,526,245, issued to Lathrop, a rotatable support apparatus for pipes is shown. A tubular upright mast 19 is rotatably supported at a lower end on a bearing 12. A platform 21, horizontally fixed at the lower end of the tubular mast 19, supports a number of elongated articles extending vertically upward which are retained by an upper circular band or ring 42. Partition walls are provided to segregate the elongated articles according to size or for other reasons. The support apparatus of Lathrop suffers, however, from the sometimes difficult procedure of withdrawing articles. Specifically, if the support apparatus is filled with elongated articles, it is difficult to withdraw one article from within the solidly packed bunch of articles.

The present invention provides a space-efficient storage and display unit which overcomes the drawbacks of the prior art.

SUMMARY OF THE INVENTION

The present invention provides an article merchandising system, particularly useful for storing elongated steel articles such as angle iron, square and round tubing, rods, etc. However, although the present invention is described and shown in terms of a fairly large rugged system for storing articles found in typical hardware or building supply stores, the inventive aspects may be incorporated into devices for storing other long items as well. The present merchandising system is designed to be a space-efficient unit having separate storage compartments for various items with a high level of visibility of the items and ready access thereto. In addition to the improved storage and retrieval aspects, the merchandising system incorporates an enhanced display and item identification feature resulting in a clearly understandable, self-serve unit especially suited for large hardware and building supply stores having a minimum of sales personnel.

The merchandising system comprises a base, a rugged bearing, and a tall cylindrical upright storage rack rotatably mounted on the bearing, the storage rack having an upper central pipe sized to extend into a rotation support sleeve. A cross bar may be provided having a rotation support sleeve for receiving the upper central pipe of the storage rack, the cross bar being adapted to mount between elements of a large storage scaffold, as commonly found in building supply outlets. The base of the merchandising system is preferably bolted to the floor of the warehouse or retail outlet so that the merchandising system is rigidly attached at the bottom and is also bolstered at the top by the cross bar and scaffolding structure. The cylindrical storage rack rotates about the lower bearing in the base and within the sleeve of the cross bar, defining a vertical axis of rotation along the central axis of the cylindrical rack.

The cylindrical storage rack comprises a lower circular platform on which bottom ends of articles rest, a plurality of upstanding legs mounted proximate the periphery of the platform, an upper support structure stage at the top of the legs, and at least one intermediate article brace for supporting the top ends of the articles upright. A bottom lip or peripheral band around the circumference of the platform retains the bottom ends of the articles within the rack. A portion of the intermediate article brace is defined by a peripheral retaining band preferably attached outside of the upright support legs.

A plurality of spacers are centered on the storage rack axis at the platform and at every intermediate article brace. The spacers are rigidly attached to the upright legs and aforementioned peripheral bands by struts or spokes, thus defining a plurality of truncated pie-shaped regions between the outer edge of the spacers and the peripheral bands. The pie-shaped regions represent product homes which segregate the articles into categories. Desirably, a corresponding number of product homes exist in the platform and in the intermediate braces. Articles are segregated into the various product homes depending on type, size, material, application, etc. Articles thus rest on the platform with their bottom ends retained in lower portions of the product homes defined by the spokes in the platform. Upper portions of the product homes, directly above the lower portions, and defined by the spokes in the intermediate article braces, support the top ends of the articles in order to hold the articles upright. The storage rack may then be rotated to present different product homes to the customer.

The central spacers bar articles from around the central vertical axis of the storage rack creating a hollow cylindrical volume within the rack. The hollow regions above the intermediate article braces provide a relief cavity in which to tilt the upper ends of articles when removing the articles from the rack. A typical removal procedure involves lifting the bottom end of an article over the bottom lip of the platform and pulling the bottom end outward from the rack. The top end thus tilts into the central relief cavity, the article pivoting about the edge of the spacer in the intermediate brace. The article is withdrawn until the top end clears underneath the retaining band around the intermediate brace, whereupon the article is free from the rack and can be tipped back vertically.

In the simplest embodiment of the merchandising system of the present invention, the storage rack includes one intermediate brace in order to store one or more lengths of articles. The storage rack includes a minimum of three vertical support legs and thus a minimum of three spokes extend outward from the spacers in the platform and intermediate brace to each leg. In this simple embodiment, therefore, three product homes are created for storing one to three different types of articles.

In a preferred embodiment, however, the storage rack accommodates at least two lengths of articles and includes four upright supporting legs. This storage rack includes at least two intermediate braces vertically spaced above the platform. A first intermediate brace includes a first spacer and one spoke to each of at least two legs, the spokes defining at least one product home for shorter articles. The first spacer may be a quarter-, semi-, or three-quarter circle requiring two, three or four spokes minimum, respectively. Thus, shorter articles are stored in the vertical truncated pie-shaped volumes defined by spokes of the platform and the first intermediate brace. A second intermediate brace, mounted across the legs above the first intermediate brace, provides an upper support for longer articles. The second brace includes a second spacer above the cut-out portion of the first spacer, the second spacer having a quarter-, semi- or three-quarter circular shape requiring two, three, or four spokes minimum, respectively.

Preferably, the first and second spacers are semicircular and include three primary spokes to three of the upright legs plus a plurality of secondary spokes between the primary spokes to define smaller product homes. The secondary spokes extend between the spacers and the outer retaining band. The platform includes a corresponding number of spokes to define the lower portion of the product home. Thus, for example, the storage rack may be slightly taller than the longest article and the second intermediate brace is located just below the upper support structure stage in order to retain the top ends of taller articles in the product homes arranged around one-half of the cylindrical rack. The first intermediate brace then mounts to the support legs slightly below the height of the shorter articles. The first intermediate brace thus retains the top ends of the shorter articles in product homes arranged around a second half of the cylindrical rack. For added support, a vertical center pole may be attached to the center of the two partial spacers and to the center of the upper support structure stage.

In accordance with one aspect of the present invention, more than one different length of article may be stored in a rack having only one intermediate brace. In the previous configuration, the intermediate braces were disposed slightly below the top ends of articles so that when tilting the bottom end out, the top end pivots into the central relief cavity only a short distance, and thus the central spacers may be sized quite small. With the use of larger central spacers, however, a larger central relief cavity is formed and there is more room into which the top ends of the articles may be tilted. As a result, the top ends of articles having a limited difference in length may be supported by an intermediate brace having a relatively large central spacer. The brace is positioned slightly below the top end of the shortest articles so that the top end of the longer articles extends upward a certain distance farther. When removing the longer articles, the top end swings into the central relief cavity, which is of a sufficient width to preclude contact with articles on the opposite sides of the spacer across the cavity. In fact, the longer articles may be tilted nearly horizontal prior to being withdrawn due to the wide relief cavity.

In accordance with another important aspect of the merchandising system of the present invention, the rotatable storage rack may be divided vertically by a second article support platform. The second platform divides the rack into lower and upper storage areas in order to maximize the storage efficiency in the volume above the base. Ideally, intermediate length articles are stored in the lower storage area while shorter length, lighter weight articles are stored above in the upper storage area.

In a preferred embodiment of the merchandising system having the capacity for storing multiple intermediate article lengths and shorter article lengths, the storage rack comprises a platform with a central spacer having a plurality of outwardly extending spokes joined to four upstanding legs and to a bottom lip around the periphery of the platform, a first intermediate brace for supporting the top ends of articles resting on the platform, a second article support platform above the first brace for supporting shorter articles and a second intermediate brace bolstering the top ends of the shorter articles, in addition to the aforementioned upper support structure stage and upwardly extending rotation support pipe.

With respect to another aspect of the merchandising system of the present invention, a preferred product information display system is incorporated in order to facilitate simple identification and removal of the various stored products. The display system comprises descriptive labels applied to the exterior surfaces of the various peripheral retaining bands. In a preferred embodiment, each of the intermediate braces includes a 3-inch wide peripheral retaining band sufficient to receive labels having detailed product information. Moreover, separate labels are used to identify products within each product home, defined between the spokes. It is a simple matter to install and replace labels, thus providing a great degree of merchandising freedom.

Additionally, wider bands may be provided to display other, more detailed product or application information, or for other marketing purposes. In the preferred configuration having a vertically divided storage rack, the band surrounding the second article support platform is approximately 6 inches wide. This enlarged band is used to display overall product information, such as drawings of the articles within the storage rack, or may identify groups of articles within one quadrant of the rack, for example. The smaller bands are then used to describe specific lengths, materials, shapes or sizes within individual product homes. The merchandising system therefore provides a compact, accessible, easy to use storage rack with a handy reference guide for general and specific needs.

The merchandising system is designed to storage elongated, typically metallic articles, such as angle iron, square and round tubing, rods, etc. In order to enhance the usefulness of the merchandising system, one or more partitioned trays for holding fasteners or the like is also provided. Such a tray may have a circular bottom with shallow vertical partitions extending from the center outward to join with a peripheral wall, thus creating a plurality of pie-shaped receptacles. Advantageously, the tray is mounted to the legs of the storage rack and includes a number of receptacles corresponding to the number of product homes, although other configurations are possible. In the vertically divided storage rack, as an example, the tray is mounted below the second article support platform a sufficient distance to create a gap large enough for viewing and accessing the fasteners. In accordance with the integrated storage and display system of the present invention, identification labels may be applied to the exterior surface of the peripheral tray wall in order to identify the separated fasteners or the like.

In still another embodiment, the merchandising system comprises two or more storage racks and functions as a stand-alone unit. For instance, two upright cylindrical storage racks may be rotatably mounted on one base and have their upper ends coupled for stability. The added width of the base and upper coupling of the racks eliminates the need for bracing the merchandising system to an existing scaffold structure and the system may therefore be installed in any business having a sufficiently tall ceiling.

In one preferred embodiment, the merchandising system comprises two storage racks rotatably mounted side-by-side on the base; one rack capable of storing and displaying articles having lengths of between 1 and 4 feet, and the other rack capable of storing articles of between 5 and 6 feet long. In the preferred embodiment, front and rear vertical beams are attached to the base intermediate to racks, the beams extending upward to a connecting beam thus forming a generally inverted U-shape. A rack constraining beam mounts across the center of the connecting beam, the rack constraining beam extending transversely over the upper axles of the storage racks. The upper axles loosely fit within apertures in the constraining beam so that the racks are supported from tipping front or back by the inverted U-shaped beam structure.

An alternative fastener or other small article storage and display assembly is preferably utilized in the stand-alone merchandising system. A plurality of receptacles are vertically stacked and mounted to the front vertical support beam rather than having a partitioned tray within the storage racks themselves. The small article storage and display assembly generally comprises a trapezoidal-shaped open-ended box stood on one end with a number of horizontal shelves mounted within, a front barrier being provided for each shelf for retaining articles. The assembly is attached to the front vertical beam with the receptacles facing forward and the narrow side of the trapezoid pointing between the cylindrical storage racks.

In order for the storage rack of the present invention to rotate easily without fear of fatigue failure, extra heavy-duty bearings are provided between the rack and the base. These bearings are engineered for extremely heavy use for long life of the merchandising system.

DESCRIPTION OF THE PREFERRED EMBODIMENTS

Merchandising System for Intermediate and Short Articles

Figure 1:
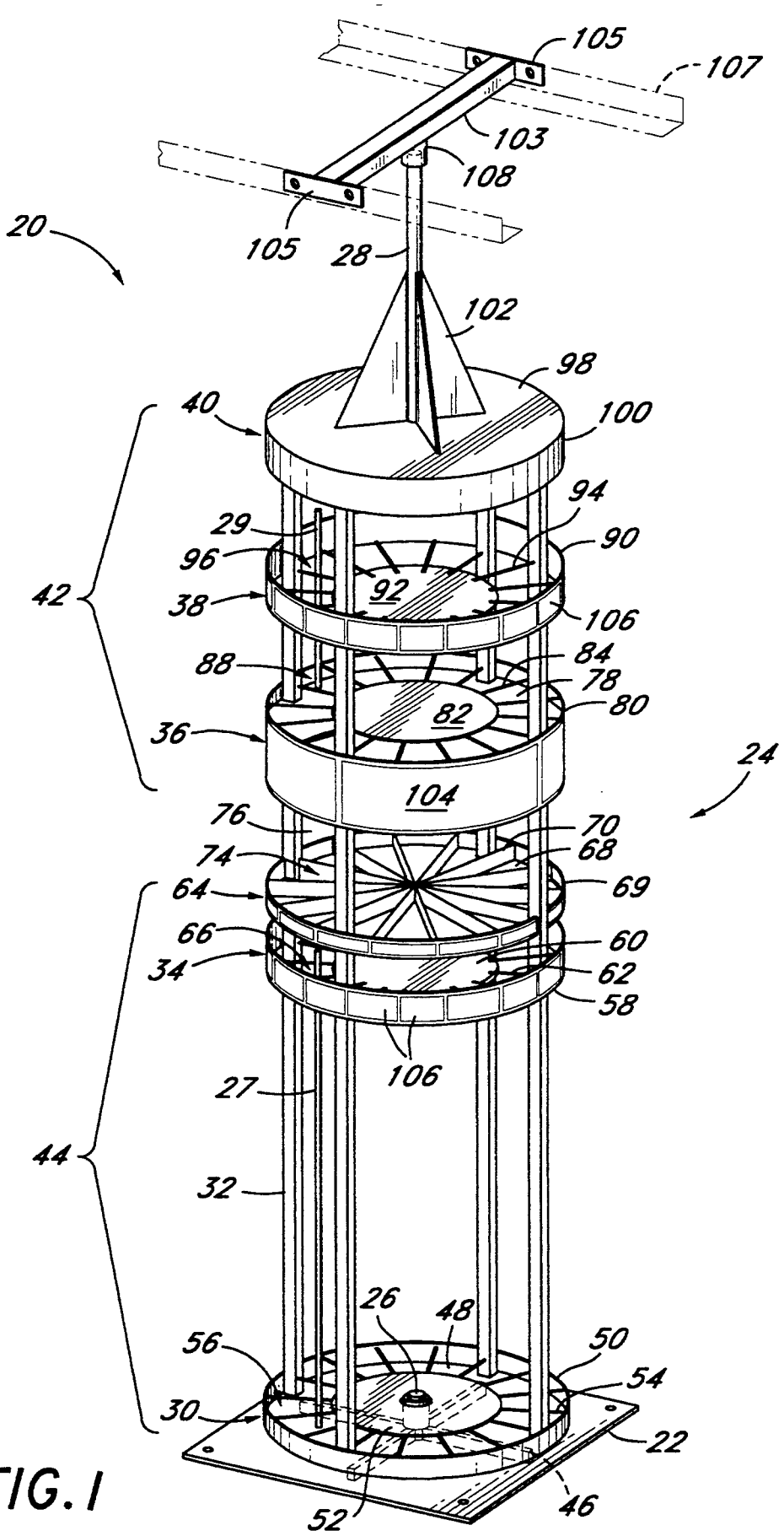
FIG. 1 is perspective view of a preferred embodiment of the merchandising system of the present invention and an upper support structure.

A merchandising system 20 for storing and displaying elongated articles is shown in FIG. 1. The merchandising system 20 generally comprises a flat base 22, an upright cylindrical storage rack 24 rotatably supported on the base by a hub or bearing 26, and an upper rotation support pipe 28 extending from the top surface of the storage rack. The bearing 26 defines an axis of rotation of the system 20. The merchandising system 20 is designed to retain elongated articles 27 such as, for example, tubes, long pieces of steel or iron, threaded rods and the like. In this regard, the merchandising system 20 is relatively large and ruggedly constructed. The merchandising system 20 also retains shorter articles 29 in an upper portion. Preferably, the merchandising system 20 comprises elements of steel which are welded together. However, as will be apparent from the description of the inventive aspects of the present invention, the merchandising system may be constructed smaller and with different, perhaps less sturdy materials, and used to support and display a wide array of smaller and/or lighter articles.

Figure 2:
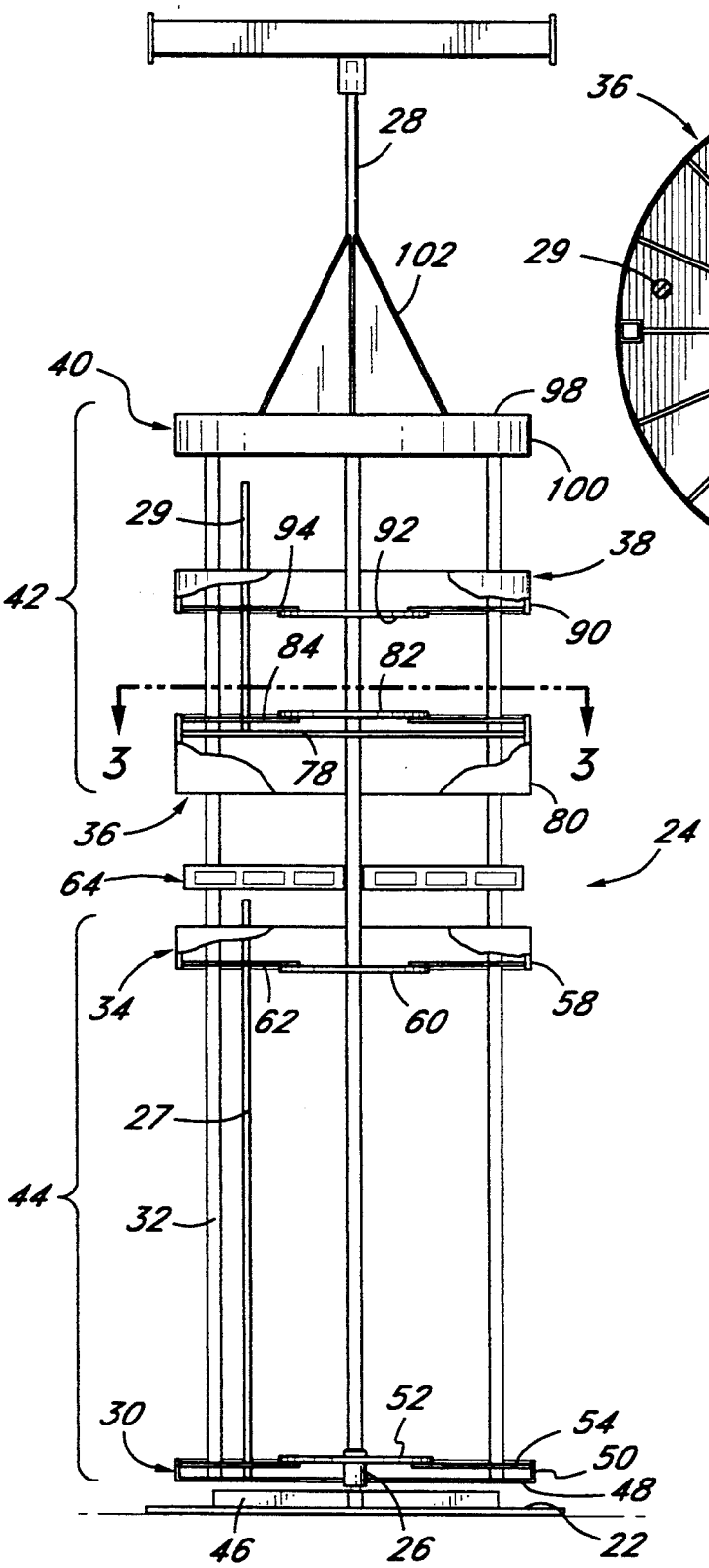
FIG. 2 is a front elevational view of the merchandising system of FIG. 1.

With reference to FIGS. 1 and 2, the storage rack 24 rotatably supported on the base 22 generally comprises a primary floor or platform 30, four upstanding legs 32 mounted to the platform, a first intermediate article brace 34, a secondary article support platform 36, a second intermediate article brace 38 and an upper support structure stage 40. The storage rack 24 shown in FIGS. 1 and 2 is divided into an upper article storage area 42 and a lower article storage area 44. In general, intermediate length articles 27 rest on the primary platform 30 and have their top ends supported by the first intermediate article brace 34. Articles of shorter length 29 are retained in the upper article storage area 42 with the bottom ends resting on the secondary article support floor or platform 36 and the top ends being bolstered upright by the second intermediate article brace 38.

The base generally comprises a square flat rigid plate which includes through holes for bolting the base to a foundation (not shown), such as the floor of a building supply outlet. Although the bearing 26 is shown schematically, a stationary lower portion attaches to the base 22 by corner welding or other means and a rotating portion attaches to the storage rack 24. The bearing 26 may be any number of rugged bearings. As will be apparent from the following description, the storage rack extends upward to a height of 7 feet and the articles stored within the storage rack are typically steel rods and bars, thus the weight supported by the bearing is quite substantial. The preferred bearing 26 includes a plurality of roller bearings (not shown) distributed in a conical pattern to provide both rotational and thrust support and ensure a relatively long life of the merchandising system 20. A plurality of outwardly extending reinforcing ribs 46 are welded to the stationary lower portion of the bearing 26. In the preferred embodiment, there are four reinforcing ribs 46 in a cross pattern which extend outward to prevent the bearing 26 from tilting. The reinforcing ribs 46 are welded both to the bearing 26 and to the upper surface of the base 22. Desirably, the reinforcing ribs 46 are flat steel pieces with relatively high resistance to bending about axes running through the thin cross section.

The primary platform 30 of the merchandising system 20 generally comprises a circular bottom plate 48 surrounded by a peripheral retaining band or lip 50 and a central disk-shaped spacer 52 having outwardly extending spokes 54. Both the bottom plate 48 and the central spacer 52 include a central aperture through which the bearing 26 protrudes. The bottom plate 48 and central spacer 52 are welded to a rotating portion of the bearing 26. The lip 50 has a sufficient width to provide a peripheral retainer for the bottom ends of articles 27 placed on the primary platform 30. The central spacer 52 is spaced slightly above the bottom plate 48 and the spokes 54 are welded to the underside of the central spacer and, at their other ends, to either the peripheral lip 50 or one of the four upstanding legs 32. Due to the spacing between the spacer 52 and bottom plate 48, the outer end of the spokes 54 thus join to locations on the lip 50 and legs 32 slightly spaced above the bottom plate 48.

In one embodiment, there are a total of 16 spokes 54 in the primary platform 30. The spokes 54 extend outward from the spacer 52 with an equivalent spacing therebetween to divide the region between the spacer and the lip 50 into equal truncated pie-shaped sections 56. As will be further clarified below, each pie-shaped section 56 defines a lower portion of a product home for segregating articles stored in the storage rack 24.

The first intermediate article brace 34 is attached to the four upstanding legs 32 at a distance above the primary platform 30 sufficient to brace the top ends of articles 27 resting on the platform. The first intermediate article brace 34 generally comprises an outer retaining band 58 welded to the outside of the upstanding legs 32, a central disk-shaped spacer 60, and a plurality of spokes 62 welded both to the central spacer and to the peripheral retaining band or upstanding legs. A nut tray 64 is attached to the legs 32 slightly above the article brace 34, and will be described below. The central spacer 60 and attached spokes 62 mount to the lower edge of the retaining band and to similar locations on the upstanding legs 32. There are a corresponding number of spokes 62 as the number of spokes 54 in the primary platform 30. Thus, a similar number of truncated pie-shaped sections 66 are created by the spokes 62 as in the primary platform 30. The upper and lower pie-shaped sections 56, 66 between the spokes 54, 62 combine to define a product home for elongated articles 27 resting on the platform 30. In this respect, the bottom end of a particular article 27 is retained within a lower pie-shaped section 56 in the primary platform 30 and the top end is retained within an associated upper pie-shaped section 66 directly above. The elongated article is held within the storage rack 24 by both the lower lip 50 and intermediate retaining band 58 and is held a certain distance from the central axis of the merchandising system 20 by the central spacers 52, 60. Thus, there is provision for 16 various types of elongated articles to be retained within the 16 product homes created by the primary platform 30 and intermediate article brace 34.

The nut tray 64 is comprised of a flat bottom 68, an outer circular nut barrier 69 and a plurality of upstanding partitions 70. The bottom 68 is a generally circular plate having four square peripheral cutouts to accommodate the four square cross section legs 32. The partitions 70 are disposed in a star shape across the bottom 68 and generally divides the nut tray 64 into a plurality of pie-shaped receptacles 74 for storing fasteners or other small objects to be used with elongated articles held in the upper or lower article storage area 42, 44. The nut tray 64 may be rigidly attached to the upstanding legs 32 a short distance above the first brace 34 or, alternatively, at the level of the first brace, in which case the partitions are welded to the retaining band 58 which thus forms the nut barrier 69. As shown in FIG. 2, a vertical space 76 exists between the first intermediate article brace 34 and the second article support platform 36. The space 76 is determined by the amount of room necessary to view, select and remove a fastener in the nut tray 64.

Figure 3:
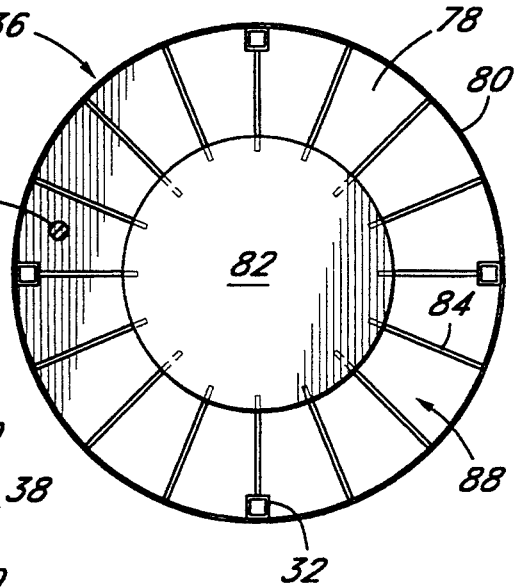
FIG. 3 is a plan view of a middle article support of the merchandising system of FIG. 1 taken along lines 3—3 of FIG. 2

As best seen in FIGS. 1 and 3, the secondary article support platform 36 is also welded securely to the four upstanding legs 32, and generally comprises a circular base portion 78, a wide peripheral retaining band 80, a central disk-shaped spacer 82 and a plurality of spokes 84 extending outwardly from the spacer to the peripheral band and upstanding legs 32. The generally circular base 78 is disposed slightly below the top edge of the retaining band 80 and is welded thereto in addition to being welded to the legs 32 at peripheral square cutouts. The central spacer 82 is positioned a distance above the base 78 so that the outwardly extending spokes 84 contact the upper edge of the retaining band 80, with four of the spokes 84 welded directly to the upstanding legs 32. Thus, a plurality of truncated pie-shaped sections 88 are formed in an identical manner as the pie-shaped sections 66 in the primary platform 30. The pie-shaped sections 88 thus comprise the lower portion of a product home in the upper article storage area 42. The bottom ends of elongated articles 29 are placed in the pie-shaped section 88 and are restrained by the spokes 84, the central spacer 82 and the outer retaining band 80.

The distribution of the spokes 84 is clearly seen from above in FIG. 3. In the secondary article support platform 36, the spokes 84 attach to the underside of the central spacer 82 and then extend outward to the periphery. It will be noted that the spokes of the present invention may be attached to the lower or upper side of the spacers, dependent on whether the particular spacer is located at the upper or lower end of the corresponding platform or brace. More specifically, the lowest central spacer 52 in the primary platform 30 is located at the upper end of the platform, and is visible from above so that it is preferable to attach the spokes 54 to the underside of the spacer. Likewise, the central spacer 82 of the secondary article support platform 36 may be viewed from above and thus the spokes are also attached to the underside of the spacer for aesthetic reasons.

The second intermediate article brace 38 is attached to the upstanding legs 32 a certain distance above the secondary article support platform 36 and provides a support for the top ends of elongated articles 29 resting on the platform. A peripheral retaining band 90 is attached to the outer side of the legs 32 and a central disk-shaped spacer 92 is attached to the peripheral band and to the legs via a plurality of spokes 94. The spokes 94 divide the second intermediate article brace 38 into truncated pie-shaped regions 96 representing upper portions of product homes in the upper article storage area 42. Elongated articles 29 rest on the secondary article support platform 36 with the top ends bolstered upright by the second article brace 38. It is generally preferable to attach the secondary article support platform 36 to the upstanding legs 32 at a height above the mid-point of storage rack 24 so that shorter articles of lighter weight may be stored in the upper storage area 42.

The upper support structure stage 40 generally comprises a circular plate 98 having a peripheral downwardly depending skirt 100. The upper rotation support pipe 28 is welded to the top surface of the plate 98 and includes triangular reinforcing gussets 102 for rigidity. The gussets 102 are distributed in an even manner around the pipe 28. The upper end of the pipe fits within a receiving sleeve of a fixed support structure. The stage 40 may be any other configuration suitable for mounting the upper support structure.

One upper support and bracing structure is shown in FIGS. 1 and 2 and comprises a bracket or crossbeam member 103 attached at end flanges 105 to a fixed scaffold 107 and having a downwardly depending tube 108. The pipe 28 fits loosely in the tube 108, thus providing a relatively low-friction rotational support. The entire storage rack 24 thus rotates about its central axis by virtue of the lower bearing 26 and upper pipe 28 within the support tube 108.

Various lengths, shapes, sizes, or materials of elongated articles are placed within the product homes of the upper and lower article storage areas 42, 44. The elongated articles may be removed from the storage rack 24 by slightly lifting the article so that the bottom end clears the respective retaining band in one of the platforms whereupon the bottom end is swung outward and the article removed. It is important to note that, when being removed, the elongated articles pivot about the outer edge of the spacers 60, 92 in the first and second intermediate article braces 34, 38. The tilting of the elongated articles causes the top ends to swing into the middle of the storage rack 24 which is kept clear by the provision of the central spacers. In fact, with the storage rack 24 completely filled with elongated articles, the spacers in the intermediate article braces 34, 38 create a central relief cavity above them to provide the room within which the top end of the article may swing when removing the article. The diameter of the central relief cavity depends on the diameter of the spacers and the size also determines the angle at which the elongated articles may be tilted, the maximum tilt angle also depending on the height of the article above the spacer.

In the lower article storage area 44, the elongated articles 27 may be approximately 3 feet tall and the first intermediate article brace 34 is thus disposed slightly less than 3 feet above the primary platform 30. The spokes 62 are at a height slightly below the top end of the 3-foot articles. The bottom 68 of the nut tray 64 is located a sufficient distance above the top end of the 3-foot articles to allow the articles to be lifted over the lip 50 of the primary platform 30. Due to the close fit between the nut tray 64 and spokes 62, only a small range of sizes of elongated articles may be stored in the lower storage area 44.

To the contrary, the upper article storage area 42 is capable of supporting elongated articles 29 of different lengths. In a preferred embodiment, the second intermediate article brace 38 is located approximately 1 foot above the secondary article support platform 36. Thus, articles having a length of 1 foot may rest on the secondary platform 36, their top ends being supported in the pie-shaped sections 96 formed by the spokes 94. Due to the clearance between the second intermediate article brace 38 and the stage 40, longer articles, preferably up to 2 feet, may fit between the secondary platform 36 and the stage. It is a simple matter to remove the 1-foot long articles as their top ends do not swing very far into the central relief cavity. The 2-foot long articles, on the other hand, may be removed by lifting over the retaining band 80 and tilting the bottom end of the article outward. The top end of the article swings into the central relief cavity above the central spacer 92. The 2-foot long article has approximately 1 foot extending above the spacer 92 and the spacer is preferably large enough to accommodate the top end so that the article may be tilted until it can be removed.

In one preferred embodiment, the base 22 comprises a square of 22 inches on each side and the cylindrical storage rack 24 has a diameter of 22 inches. Each of the retaining bands 50, 58, 80 and 90, as well as the upper skirt 100, comprise loops having a diameter of 22 inches. The central spacers 52, 60, 82 and 92 are preferably 12 inches in diameter. The distance between the outer edges of the spacers and the retaining bands is thus 5 inches and the spokes preferably have a length sufficient to contact the outer retaining bands and to overlap the spacers somewhat. Most preferably, the spokes have a length of 6 inches and overlap the central spacers by 1 inch (as seen in FIG. 3). The length of the upright legs 32 is preferably 77 inches; the distance from the primary platform 30 to the first intermediate article brace 34 is approximately 3 feet, the distance between the first brace to the secondary platform 36 is approximately 1 foot, the distance from the secondary platform to the second intermediary article brace 38 is approximately 1 foot and the distance from the second brace to the stage is also approximately 1 foot. The extra 5 inches is accounted for by the room provided immediately above the spokes to lift the articles when removing.

In accordance with an important aspect of the merchandising system 20, a versatile product display system is incorporated. Various product information labels are applied to the exterior surface of the retaining bands. General information pertaining to the shape or application of particular articles in the storage rack 24 is displayed on large display labels 104 adhered to the wide retaining band 80 in the secondary article support platform 36. The wide retaining band 80 is preferably between 5 and 7 inches wide, and more preferably is 6 inches wide. A substantial amount of visual and/or sales information may be printed on the large labels 104 to give the customer a sense of what is included in the storage rack and what the articles may be used for. Furthermore, the large labels 104 may be placed from one leg to the next leg to disclose what type of articles are stored in that particular quadrant of the storage rack 24. A plurality of smaller labels 106 disclose the contents of each individual product home. The small labels 106 are adhered to the exterior surface of the retaining bands 58, 90 in the first and second intermediate article braces 34, 38. This display system renders the merchandising system 20 a substantially self-serve item, and is advantageous for the typical do-it-yourselfer searching through an often cavernous building supply store. Typically, the elongated articles stored within the merchandising system 20 require no further explanation than what is given on the labels 104, 106.

Merchandising System for Tall Articles

Figure 4:
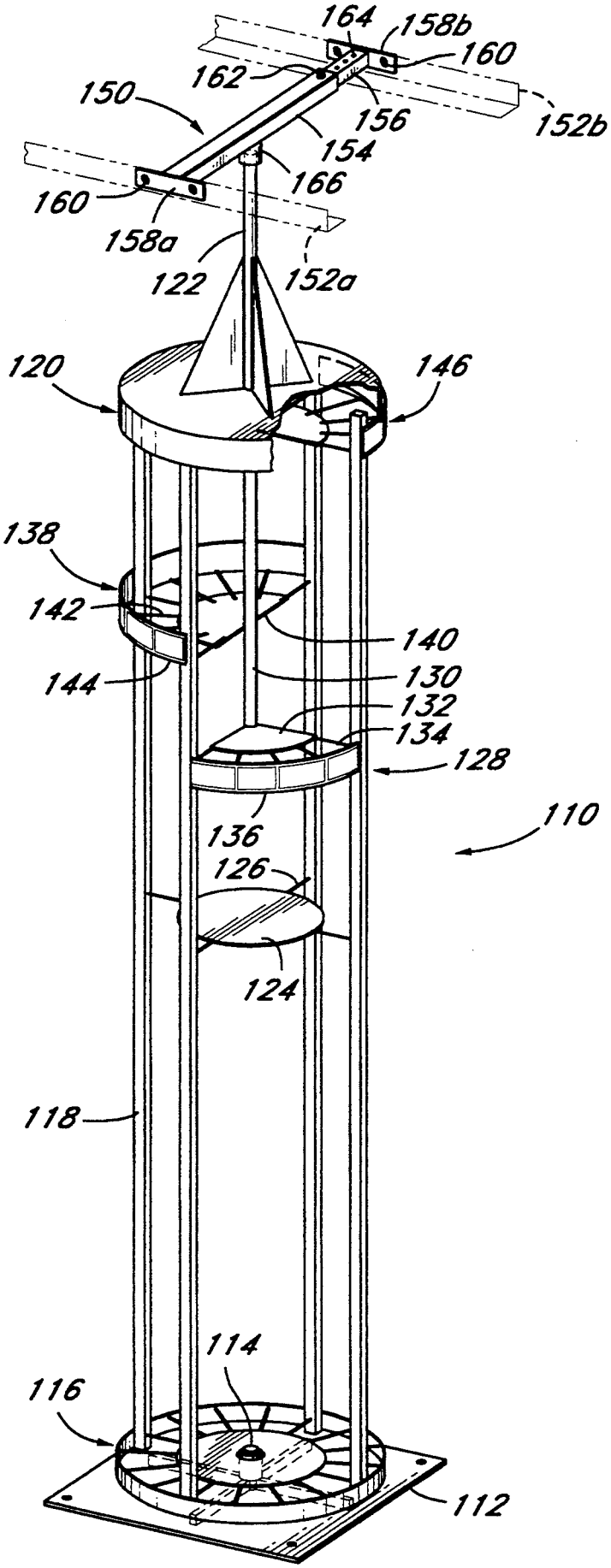
FIG. 4 is a perspective view of an alternative embodiment of the merchandising system also showing an adjustable upper mounting structure.

An alternative embodiment of the merchandising system is shown in FIG. 4. A storage rack 110 is rotatably supported on a base 112 by a bearing 114 in a similar manner as was described previously. The storage rack 110 generally comprises a floor 116, four upstanding legs 118, a number of intermediate braces and an upper stage 120. An upper rotation pipe 122, similar to that described before, is mounted to the stage 120. A lower central disk-shaped spacer 124 is attached to a location approximately 3 feet above the floor 116 on the legs 118. The spacer 124 is attached to the legs 118 by four spokes 126. A short article brace 128 is attached to two of the legs 118 and to a central support rod 130. The short article brace comprises a quarter circle plate 132 having five outwardly extending spokes 134 attached to the underside of the quarter circle and to the two legs 118 or to a short arcuate retaining strip 136. Slightly farther up the storage rack 110, an intermediate length article brace 138 comprises a central semi-circular spacer 140 attached to the central rod 130 and having outwardly extending spokes 142 contacting three of the four legs 118 or a generally semi-circular retaining band 144. A tall article brace 146 is attached to the central rod 130 and to two of legs 118 or a peripheral skirt 148 slightly below the stage 120.

The bottom ends of short, intermediate and tall articles rest on the floor 116, which is of a similar construction as the primary platform 30 of the merchandising system 20 of FIG. 1. Thus, the floor 116 includes the lower portion of 16 product homes. The shorter articles are placed in the four product homes in the quadrant below the short article brace 128. Thus, the short articles stand upward and are supported at the top end by the short article brace 128. Intermediate length articles are placed in the eight product homes in the floor 116 underneath the intermediate article brace 138. Thus, the top ends of the intermediate articles are held within the upper portion of the respective product homes defined by the spacer 140, spokes 142 and retaining band 144. Likewise, tall articles are placed in the four product homes in the quadrant of the floor 116 underneath the tall article brace 146 and the top ends are held within the upper portion of the respective product homes defined by the spokes in the tall article brace.

In one configuration, the storage rack 110 shown in FIG. 4 is suitable for storing elongated articles of 5, 6 and 8 feet. In this respect, the storage rack 110 is slightly greater than 8 feet tall, and more preferably between 96 and 100 inches tall. Most preferably, the storage rack is 96 inches tall from the floor 116 to the stage 120. The tall article brace 146 is disposed under the skirt 148 of the stage 120, and thus 8-foot long articles resting on the floor 116 extend upward to have the top ends supported by the tall article brace. Likewise, the intermediate article brace 138 is located slightly less than 6 feet above the floor 116 to be capable of supporting the top ends of 6-foot long articles. The short article brace 128 is positioned slightly below 5 feet from the floor 116 in order to support the top ends of 5-foot long articles. The lower central spacer 124 serves to support the legs 118, and also to maintain the articles around a central hollow volume.

As per the previous discussion, the function of the central spacers in the short and intermediate article braces 128, 138 preventing articles from being stacked within the central relief cavity allows varying lengths of articles to be supported. For example, the short article brace 128 may support articles greater than 5 feet tall up to approximately 6 feet tall, and the intermediate article brace 138 may provide support for articles of between 6 and 7 feet tall.

The top end of the merchandising system, as shown in FIG. 4, is supported by a cross bar 150 fixedly attached at both ends to existing scaffolding members **152*a*, 152*b*, the scaffolding commonly used in hardware retail outlets or building supply stores for storing and displaying various goods. The cross bar 150 may be adjustable and include an outer square tubular member 154 and an inner square tubular member 156 sized to slide within the outer member. The distal ends of both the outer and inner members 154, 156 include outwardly extending flanges 158*a*, 158*b* having through holes 160 for bolting or otherwise fastening to the scaffolding members 152. An adjustment fastener 162 extends through a hole in the outer member 154 and also through one of a series of adjustment holes 164 in the inner member 156. Consequently, the span between the flanges 158 of both the inner and outer members may be adjusted by changing the particular hole 164 used. This adjustment is advantageous as the scaffolding members 152** may be spaced apart varying distances.

A downwardly depending sleeve 166 is sized to receive the upwardly projecting rotation support pipe 122 of the storage rack 110 or, alternatively, may be used to support the pipe 28 of the storage rack 24 of FIG. 1. The sleeve 166 is preferably welded to the lower side of the outer member 154. In the drawing of FIG. 4, the scaffolding member **152*a* faces forward toward an aisle from which customers may view the merchandising system. Thus, due to the spacing between the sleeve 166 and the front scaffolding member 152*a*, the storage rack 24 projects slightly into the aisle for ease of removal of articles within. The sleeve 166 is preferably constructed of tubular steel which loosely fits around the pipes 28, 122 without requiring any special bearing members. The cooperation between the pipes 28, 122 and the sleeve 166 provides a measure of support for the upper end of the storage racks 24, 110**, which is particularly advantageous in regions requiring special bracing for large storage structures used in public places.

Dual Storage Rack Merchandising System

Figure 5:
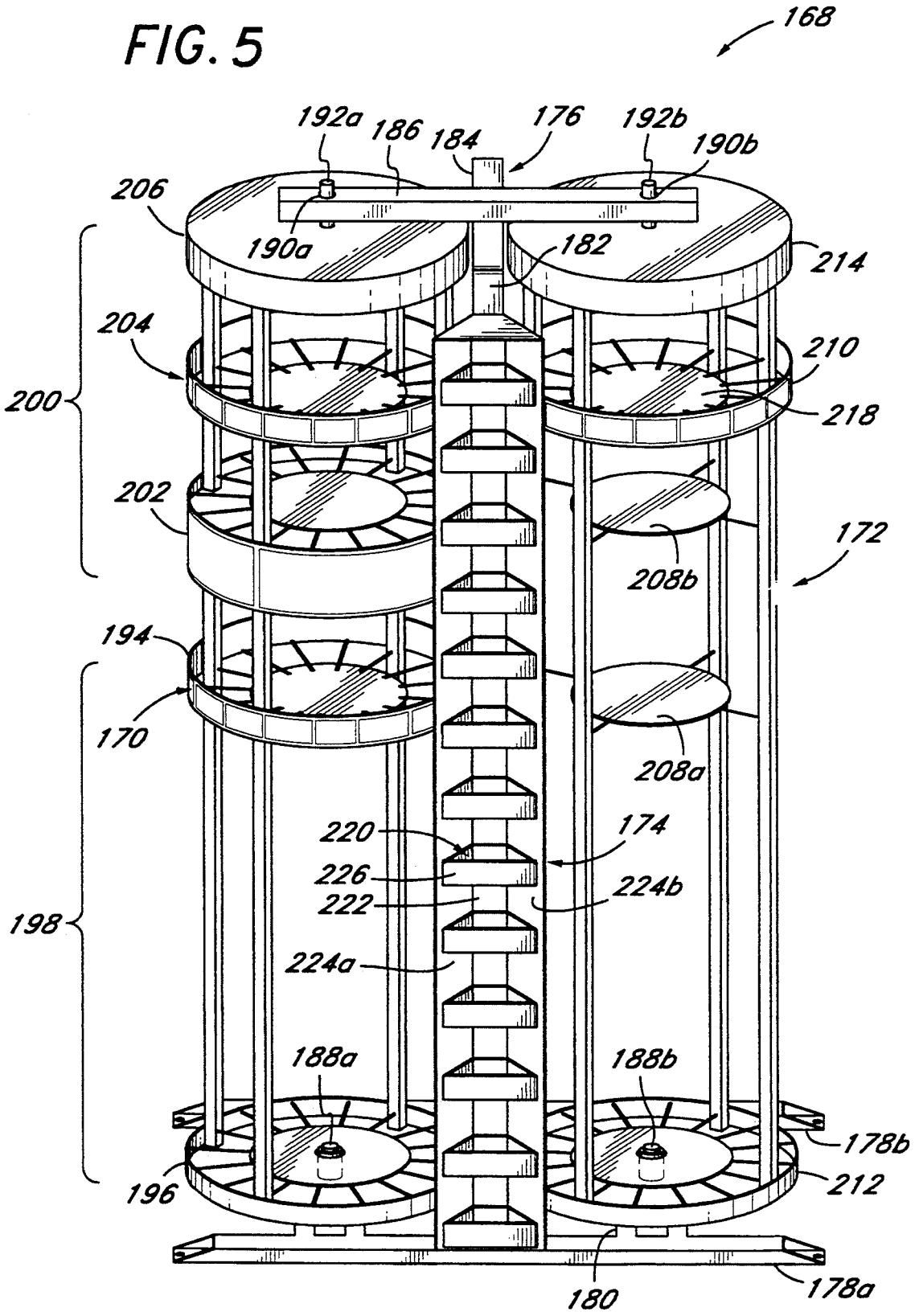
FIG. 5 is a perspective view of a dual storage rack stand-alone merchandising system of the present invention.

A merchandising system 168 shown in FIG. 5 incorporates two storage racks 170 and 172. The merchandising system 168 comprises a stand-alone version which also includes a separate fastener storage cabinet 174. The two storage racks 170, 172 are coupled by a supporting frame 176 which is bolted to the foundation of whatever building the merchandising system 168 is installed. The frame 176 is preferably constructed of heavy duty square tubular steel members, which provides a sufficient level of strength and stability to eliminate the need for connecting the merchandising system 168 at the upper end to an existing scaffolding. Consequently, the merchandising system 168 may be placed in any type of building having a ceiling height high enough to accommodate the merchandising system.

The support frame 176 comprises two transversely placed lower feet members **178*a*, 178*b*; a plurality, preferably four, of front-to-back running support bars 180; front and rear vertical beams or stanchions 182; an upper connecting beam 184; and a top transverse cross beam 186 designed to rotatably support and couple together the upper ends of the storage racks 170, 172**.

The outer ends of the support feet 178 are cut off at an angle to expose the inner surface of the bottom side which is flush with the foundation. A bolt hole and bolt may thus be accessed in the exposed channel members. The lower support bars 180 are welded to the inner sides of both feet 178 and extend across the depth of the merchandising system 168 in order to mount a support for two central bearings 188*a*, 188*b* for the storage racks 170, 172, respectively. The structure for supporting the bearings 188*a,b* may be a simple cross beam (not shown) onto which the bearings are welded, or any other suitably strong support means. The vertical stanchions 182 extend upward from the center of the feet 178 and are joined at the top across the merchandising system 168 by the connecting beam 184. The combination of the vertical stanchions 182 and connecting beam 184 forms an inverted U-shape which provides strength to the merchandising system 168 to prevent forward and backward tipping of the storage racks 170, 172. The cross beam 186 is welded to the upper side of the connecting beam 184 and includes through holes 190*a*, 190*b* into which upwardly extending shafts 192*a*, 192*b* from the storage racks extend.

The left storage rack 170 is substantially similar to the storage rack 24 of FIG. 1. Due to the provision of the central fastener storage cabinet 174, the nut tray 64 provided in the storage rack of FIG. 1 is not necessary. Instead, the first intermediate article brace 194 supports the top end of elongated articles of varying heights. For example, the brace 194 may be located approximately 3 feet above a lower article support platform 196 and be capable of bolstering the top ends of articles of between 3 and 4 feet in length, the combination of the platform and first brace thus forming a lower article storage area 198. An upper article storage area 200 is formed by a secondary article support platform 202 and a second intermediate article brace 204. The second article brace 204 is preferably spaced approximately 1 foot above the secondary platform 202, and an upper support stage 206 is spaced above the second brace by another foot. The upper article support area 200 thus provides the capacity for storing articles of between 1 and 2 feet long.

The right hand storage rack 172 includes two intermediate spacers 208a, 208b and a top end article brace 210 disposed approximately 5 feet above a lower platform 212 and 1 foot below an upper stage 214. The storage rack 172 has the capacity for storing articles of between 5 and 6 feet in length, as an upper spacer 218, forming a part of the brace 210, provides the aforementioned central relief cavity. Both the left and right hand storage racks are supported by four identical upstanding legs, preferably constructed of square steel tubing.

The fastener storage cabinet 174 comprises a tall open-ended cabinet vertically divided into fastener receptacles 220, which is mounted to the front side of the front vertical stanchion 182. The fastener cabinet 174 has a generally trapezoidal shape in horizontal cross section formed by a relatively narrow vertical back wall 222 and a pair of forwardly diverging side walls 224*a*, 224*b*. The receptacles 220 divide the storage cabinet 174 into a plurality of storage bins for fasteners or other small objects, and each is formed by a horizontal shelf (not shown) and a front retaining wall 226 to prevent the fasteners from spilling from the receptacles.

Both of the storage racks 170, 172 and the fastener storage cabinet 174 include surfaces on which to apply display labels. The left storage rack 170 includes circular bands for applying general and more specific labels, as described previously for the storage rack 24 of FIG. 1, while the right storage rack 172 includes a single circular band for applying specific labels. The front retaining walls 226 of the fastener storage cabinet 174 provide surfaces on which to apply identification labels for the various types of fasteners stored in the receptacles 220. In short, the merchandising system 168 has a large storage capacity and provides a complete information system for self-serve use by a customer to locate the proper article and fastener.

Although this invention has been described in terms of certain preferred embodiments, other embodiments that are apparent to those of ordinary skill in the art are also within the scope of this invention.

What is claimed is:

1. A merchandising system, comprising:

a lower platform;

a plurality of spaced legs attached to and extending upwardly from the platform;

an upper stage spaced above the platform and attached to the legs whereby the lower platform, the legs and the upper stage form a rigid rack;

a support structure attached to the upper stage;

a lateral support member mounted to the legs; and a primary spacer of a smaller size than said lower platform attached to the rack by a plurality of spokes, said spokes, primary spacer and lateral support member defining upper product homes, wherein upper ends of elongated articles placed on the platform and retained in said upper product homes are outwardly spaced from a central axis of said rack by said primary spacer.

2. The system of claim 1, comprising:

a base; and a bearing mounted on the base defining a rotational axis aligned with said rack central axis, said lower platform being rotatably mounted on the bearing.

3. The system of claim 2, comprising:

a peripheral rim attached to said lower platform, the legs and the spokes which extend outward from a lower spacer, the rim defining an outer barrier of lower product homes.

4. The system of claim 2, wherein said upper stage support structure comprises:

an upstanding pipe mounted on said upper stage and laterally supported by a plurality of gussets;

and wherein said system comprises:

an upper support structure bracket adapted to mount to a fixed member and provide rotational support for said pipe substantially along said rotational axis.

5. The system of claim 1, comprising:

a lower spacer of a smaller size than the platform attached to the legs vertically below said primary spacer at a location slightly above the platform by a plurality of spokes, the spokes and lower spacer defining lower product homes.

6. The system of claim 1, wherein said primary spacer is a circular disk.

7. The system of claim 1, wherein said lateral support member is a circular band.

8. The system of claim 1, wherein said primary spacer is a circular disk segment.

9. The system of claim 1, comprising:

an upper platform attached to said legs and spaced above said lateral support member; and an upper article support attached to said legs and spaced above said upper platform.

10. The system of claim 1, comprising:

a small article tray mounted to said legs above said lateral support member having receptacles corresponding to each upper product home.

11. The system of claim 1, comprising:

display labels on the exterior surface of said lateral support member for articles within each of said upper product homes.

12. The system of claim 2, comprising:

a second bearing mounted on the base defining a second rotational axis;

a second lower platform rotatably mounted on said second bearing;

a second lower plurality of spaced legs attached to the second lower platform attached to and extending upwardly from the second lower platform;

a second lower upper stage spaced above the second platform and attached to the second lower plurality of legs whereby the second lower platform, the legs and the second upper stage form a second rigid rack having a central axis coincident with said second rotational axis;

a second support structure attached to the second upper stage and coupled with said first support structure;

a second lateral support member mounted to the legs; and a second primary spacer of a smaller size than the second lower platform attached to the rack by a plurality of spokes, said spokes, second primary spacer and second lateral support member defining second upper product homes, wherein upper ends of elongated articles placed on the second lower platform and retained in said second upper product homes are outwardly spaced from the second rack central axis by the second primary spacer.

13. An article support and display system, comprising:

a base;

a bearing mounted on the base defining a rotational axis;

a lower platform rotatably mounted on the base;

a plurality of spaced legs attached to the lower platform;

an upper stage spaced above the lower platform and attached to the legs whereby the lower lower platform, the legs and the upper stage form a rigid rack;

a support structure attached to the upper stage;

a first article support brace disposed a first height above a first area segment of said lower platform comprising a band mounted to the legs and a spacer attached to the legs by a plurality of spokes; and a second article support brace disposed a second height above a second area segment of said lower platform comprising a band mounted to the legs and a spacer attached to the legs by a plurality of spokes, wherein said spokes, spacer and band in each article support brace define upper product homes for retaining upper ends of elongated articles spaced from said rotational axis.

14. The system of claim 13, wherein said first and second article support braces are approximately half the size of said lower platform in order to support articles in opposing halves of said system above said lower platform.

15. The system of claim 13, wherein said lower platform is circular.

16. The system of claim 14, wherein said first and second area segments are semi-circular.

17. The system of claim 13, comprising:

a third article support brace disposed a third height above a third area segment of said lower platform comprising a band mounted to the legs and a spacer attached to the legs by a plurality of spokes, wherein said first area segment is semi-circular and said second and third area segments are quarter circles.

18. The system of claim 13, comprising:

display labels for articles within said system on the exterior surface of said bands.

19. A multiple length article storage system, comprising:

a base structure including front and rear upstanding stanchions joined at the top by a connecting beam to form an inverted U-shape;

an upper coupling beam attached to said connecting beam; and two article support racks having upper shafts rotatably mounted to said coupling beam, each comprising:

a lower platform;

a plurality of legs attached to the lower platform spaced about a perimeter of said lower platform;

an upper stage spaced above the lower platform and attached to the legs whereby the lower platform, the legs and the upper stage form a rigid rack and said upper shaft is mounted on said upper stage;

a lateral article support member mounted to the legs; and a spacer of a smaller size than the lower platform attached to the legs by a plurality of spokes, said spokes, spacer and a surrounding band defining upper product homes, wherein upper ends of elongated articles placed on the platform and retained in said upper product homes are spaced from a central axis of said rack by said spacer.

20. The system of claim 19, wherein each storage rack comprises:

a plurality of lateral article support members for supporting a plurality of lengths of articles within each rack.

21. The system of claim 19, comprising:

a small article storage frame attached to said base structure and vertically disposed between said storage racks, comprising:

a plurality of small article receptacles having sidewalls to retain articles within.

22. The system of claim 21, wherein said racks are spaced apart and said small article storage frame is positioned on said base structure between said racks forming a generally triangular configuration.

23. The system of claim 19, wherein said racks are cylindrical.

* * * * *